US009022852B1

(12) United States Patent
Zoble et al.

(10) Patent No.: US 9,022,852 B1
(45) Date of Patent: May 5, 2015

(54) SYMBOL AND REEL SUBSTITUTION METHODS FOR MULTI-LINE SLOT MACHINES

(75) Inventors: A. Stuart Zoble, Monroe, CT (US); Anthony M. Singer, Ramsey, NJ (US); Daniel Marks, Decatur, GA (US); T. Grant Bolling, Haskell, NJ (US)

(73) Assignee: PTT, LLC, New York, NY (US)

( * ) Notice: Subject to any disclaimer, the term of this patent is extended or adjusted under 35 U.S.C. 154(b) by 223 days.

(21) Appl. No.: 13/432,140

(22) Filed: Mar. 28, 2012

Related U.S. Application Data

(63) Continuation of application No. 12/896,642, filed on Oct. 1, 2010, now abandoned.

(51) Int. Cl.
*A63F 9/00* (2006.01)
*G07F 17/34* (2006.01)

(52) U.S. Cl.
CPC ..... *G07F 17/34* (2013.01)

(58) Field of Classification Search
CPC ..... G07F 17/34
See application file for complete search history.

(56) References Cited

U.S. PATENT DOCUMENTS

| | | | | |
|---|---|---|---|---|
| 5,833,538 | A * | 11/1998 | Weiss | 463/21 |
| 6,234,897 | B1 * | 5/2001 | Frohm et al. | 463/20 |
| 6,347,795 | B1 * | 2/2002 | De Leljer | 273/143 R |
| 6,739,973 | B1 * | 5/2004 | Lucchesi et al. | 463/35 |
| 7,070,502 | B1 * | 7/2006 | Bussick et al. | 463/20 |
| 7,291,067 | B2 * | 11/2007 | Tarantino | 463/22 |
| 7,530,893 | B2 * | 5/2009 | Thomas | 463/20 |
| 7,722,457 | B1 * | 5/2010 | Marks et al. | 463/20 |
| 7,819,741 | B1 * | 10/2010 | Luciano | 463/25 |
| 7,883,405 | B2 * | 2/2011 | Robb | 463/17 |
| 8,251,794 | B2 * | 8/2012 | O'Halloran | 463/20 |
| 8,267,767 | B2 * | 9/2012 | Kryuchkov et al. | 463/20 |
| 8,337,311 | B2 * | 12/2012 | Amos et al. | 463/42 |
| 2002/0055381 | A1 * | 5/2002 | Tarantino | 463/20 |
| 2003/0040355 | A1 * | 2/2003 | Baerlocher | 463/20 |
| 2003/0064778 | A1 * | 4/2003 | Berman et al. | 463/20 |
| 2004/0053682 | A1 * | 3/2004 | Nelson et al. | 463/25 |
| 2004/0242315 | A1 * | 12/2004 | Paulsen et al. | 463/20 |
| 2005/0282607 | A1 * | 12/2005 | Gauselmann | 463/16 |
| 2006/0030390 | A1 * | 2/2006 | Okada | 463/16 |
| 2006/0116190 | A1 * | 6/2006 | Baerlocher | 463/16 |
| 2006/0178199 | A1 * | 8/2006 | Thomas | 463/20 |
| 2006/0252517 | A1 * | 11/2006 | Walker et al. | 463/25 |
| 2007/0060248 | A1 * | 3/2007 | Rodgers et al. | 463/16 |
| 2007/0105611 | A1 * | 5/2007 | O'Halloran | 463/16 |
| 2007/0287529 | A1 * | 12/2007 | Kojima | 463/20 |
| 2008/0102923 | A1 * | 5/2008 | Esses et al. | 463/20 |
| 2008/0132321 | A1 * | 6/2008 | Pau | 463/20 |
| 2008/0146344 | A1 * | 6/2008 | Rowe et al. | 463/42 |
| 2009/0069071 | A1 * | 3/2009 | Aoki et al. | 463/20 |
| 2009/0111574 | A1 * | 4/2009 | Rowe | 463/25 |
| 2009/0227357 | A1 * | 9/2009 | Rasmussen | 463/21 |
| 2009/0298573 | A1 * | 12/2009 | Bramble | 463/20 |
| 2009/0318215 | A1 * | 12/2009 | Acres | 463/20 |
| 2010/0210343 | A1 * | 8/2010 | Englman et al. | 463/20 |
| 2011/0263314 | A1 * | 10/2011 | Chim et al. | 463/20 |
| 2013/0084944 | A1 * | 4/2013 | Yoshimi | 463/20 |

* cited by examiner

*Primary Examiner* — Seng H Lim
(74) *Attorney, Agent, or Firm* — Jon A. Fallon, Esq.; Candice B. Hebden, Esq.

(57) ABSTRACT

A method of operating a slot machine, and a slot machine in which the method may be used. One or more symbols on a reel are replaced with symbols prescribed by a selected schema. The schema may be selected randomly, or according to a weighted probability, or according to a count of recent plays. All symbols of one type may be replaced with one other type of symbol, or with a variety of different symbols as prescribed by the schema. A symbol stack may be replaced with another symbol stack. Symbols may be replaced on one, several, or all of the reels that make up the display.

20 Claims, 2 Drawing Sheets

SYMBOL AND REEL SUBSTITUTION METHODS FOR MULTI-LINE SLOT MACHINES

BACKGROUND

This invention relates generally to mechanical, electro-mechanical, and computer-based slot-machine-type games of chance.

To play a conventional multi-line slot machine, the player deposits money into the machine, sets the wager, spins the reels, and collects awards for winning symbol combinations appearing on selected pay lines, according to pay schedule. The reel strips are stored in the device's memory as an array of symbol numbers, or similar identifiers, ReelStrips[NUMREELS][MAXNUMSTOPS]

Where NUMREELS is constant, typically five or six, representing the number of reel strips, and MAXNUMSTOPS is the maximum of the number of slots per reel strip. Typically the reel strips have different lengths recorded in an array NumStops[NUMREELS].

Thus Reel Strips [i][j] stores the number of symbol in slot j on reel number i, for every

I<NUMREELS and j<NumStops[i].

For a concrete example, consider a slot machine with 3 reel strips having 5, 6 and 7 slots respectively. The array ReelStrips would look like Array 1:

| Array 1 | |
|---|---|
| 0 | 103 |
| 0 | 100 |
| 0 | 101 |
| 0 | 102 |
| 1 | 102 |
| 1 | 101 |
| 1 | 103 |
| 1 | 100 |
| 1 | 101 |
| 1 | 102 |
| 2 | 100 |
| 2 | 101 |
| 2 | 102 |
| 2 | 103 |
| 2 | 101 |
| 2 | 101 |
| 2 | 100 |

Where 0 is the first reel strip, 1 is the second reel strip, and 2 is the third reel strip, and 100 represents a certain symbol, for example a bar, 101 represents another symbol, for example a cherry, 102 represents a "7", 103 represents a bell, and so on. Thus ReelStrips[1][2] would represent a cherry because a cherry is represented by the number 101, and 101 is the number that is found in the array in the position of the second slot of Reel 1.

When a play is initiated, a stop is selected at random for each reel. Then a spinning-reel display is presented to the player. At the end of the play, the spinning ceases with each reel displaying its previously selected stop. The resulting display may be represented as:

$$\begin{pmatrix} ReelStrips[0][s[0]] & \dots & ReelStrips[N-1][s[N-1]] \\ \vdots & \ddots & \vdots \\ ReelStrips[0][s[0]+R-1] & \dots & ReelStrips[N-1[s[N-1+R-1] \end{pmatrix}$$

Where R represents the number of rows of the display matrix, N=NUMREELS is the number of reels, and

S[NUMREELS]

is an array into which the randomly-generated stops have been entered (in the displayed matrix, indices of the form s[i]+j are taken modulo NumStops[i], for any i<N and j<R). Any path through the R×N display matrix consisting of one symbol for each column may be considered a pay line, and customarily some subset of each pay lines is designated in the context of a particular game (see, for example, U.S. Pat. No. 5,580,053, Crouch, "Multi-Line Gaming Machine", 3 Dec. 1996).

To continue with the concrete example above, and assuming the display has two rows, at the start of play to following symbols could be randomly generated.

100 102 103

101 101 101

When the spinning ceases, the display would be caused to show the symbols corresponding to the symbol numbers above. In this case, the first row would display a bar, a "7", and a bell, and the second row would display three cherries. If the second row represented an active play line, and three cherries were defined as a winning combination, then the player would win a prize based on the bottom row of the display.

When the player starts the next play, a new array s would be randomly generated and, when the spinning ceased, the corresponding symbols displayed to the player. And so on.

Two properties of this type of play are: (a) the set of reel strips does not change, and (b) each reel stop is selected randomly and independently of each other reel stop. These properties limit the possible player experiences. For example, if each reel strip is diversely populated with symbols. If each reel strip contains, for each symbol, stacks of consecutive slot occupied by that symbol, then a typical screen shot involves the occurrences of stacks of different symbols, rather than stacks of the same symbol, across reels.

Players can suffer from boredom by playing games having various different collections of symbol graphics but all using the same game play methods and awards, casinos suffer from the players' boredom and from their inability to distinguish their games offerings from those of other casinos, and game manufacturers suffer from declining orders inasmuch as They are not able to distinguish their product lines from the product lines of other manufacturers.

U.S. Publication 2008/0,064,477, Fong et al., "Gaming Machine with Random Symbol Selection," 13 Mar. 2008, disclosed a game system in which a first symbol is selected from a symbol set for display in a top row of a column, then a second symbol is selected from the symbol set for display in the middle row of the same column. The symbol set is modified between selections. For example, after the first symbol is selected, any like symbols are removed from the symbol set before the second symbol is selected, thereby preventing the same symbol from appearing in two consecutive rows of the same column. In similar fashion, the symbol set is again modified after selection of the second symbol by removing any like symbol, and then a third symbol is selected for display in the bottom row of the same column. This technique assures each symbol displayed in any one column will differ from all other symbols displayed in the same column.

U.S. Pat. No. 7,575,514, Cuddy et al., "Gaming Devices Having a Matrix and Symbol Generator", 18 Aug. 2009, discloses a game system in which the symbols in each of a plurality of groups of symbols are selected sequentially, and any symbol selected more than once may pay an award. For example, a left-hand column might be selected as a first group and then a middle row might be selected as a second group. One symbol lies at the intersection of these two groups, and since that symbol will have been selected twice, the player may receive an award if that one symbol is a symbol that pays.

However, there remains a need for a slot-machine-type game that provides more excitement and variety.

SUMMARY

Embodiments of the invention provide for increasing the relative frequency of certain configurations which are desirable and exciting for the player, relative for the frequency of less exciting configurations, while staying within the framework of independently stopped reels, by randomly modifying the reel strips prior to each spin through a family of formally defined substitution methods. These new methods admit correlations, across reels, of the occurrence of various symbol combinations, and thus create new varieties of exciting game play not possible in the standard framework.

Briefly and in general terms, a method of operating a slot machine responsive to a command from a player to commence a play includes selecting a symbol schema, replacing symbols on a reel with symbols prescribed by the schema, and presenting a spinning reel display to the player. If a winning combination of symbols appears in a pay line of the slot machine, the player gets an award. The schema may be selected randomly, or according to a weighted probability, or according to a count of recent plays. All symbols of one type may be replaced with one other type of symbol, or with a variety of different symbols as prescribed by the schema. A symbol stack may be replaced with another symbol stack. Symbols may be replaced on one, several, or all of the reels that make up the display.

A slot machine in which this method may be used typically includes a processor, a video display that shows spinning reels, a start control, and instructions that cause the processor to select a symbol schema, replace a plurality of symbols that make up a reel with symbols prescribed by the selected schema, depict spinning reels on the display, and if a winning combination of symbols appears in a pay line, give an award to the player.

DETAILED DESCRIPTION

Figure 1:
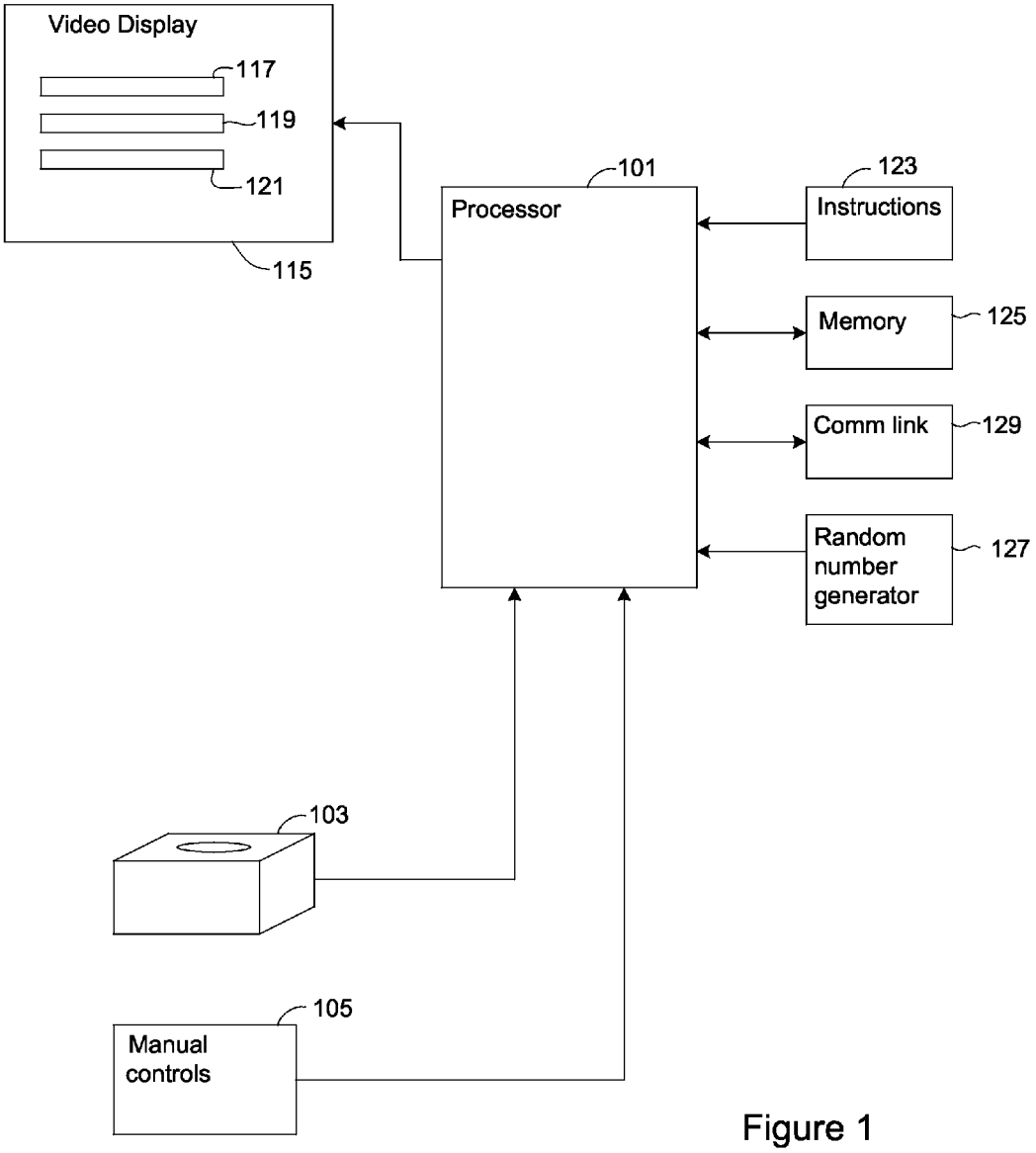
FIG. 1 is a block diagram of a slot machine in which embodiments may be practiced.

Embodiments of the invention will now be described in more detail. Consider the previously-discussed array ReelStrips[NUMREELS][MAXNUMSTOPS]

Prior to each play the array is modified. The most general form of our method involves a collection of sets of reel strips together with a probability distribution over that collection. More precisely, we use an array of sets of reel strips.

ReelStrips[NUMSETS][NUMREELS][MAXNUMSTOPS]

with the first coordinate indicating the set number, and NUMSETS as positive integer. We either associate weights, or equivalently probabilities, to each set, or simply allow the appropriate number of repetitions in the list and employ a uniform distribution. In this latter setup, a number k<NUMSETS would be randomly drawn prior to each spin, and the set ReelStrips[k][NUMREELS][MAXNUMSTOPS]

would be used for that spin in the usual fashion.

For example, the array

ReelStrips[NUMSETS][NUMREELS][MAXNUMSTOPS]

could look like array 2:

| Array 2 | | |
|---|---|---|
| 0 | 0 | 100 |
| | 0 | 103 |
| | 0 | 100 |
| | 0 | 101 |
| | 0 | 102 |
| | 1 | 102 |
| | 1 | 101 |
| | 1 | 103 |
| | 1 | 100 |
| | 1 | 101 |
| | 1 | 102 |
| | 2 | 100 |
| | 2 | 101 |
| | 2 | 102 |
| | 2 | 103 |
| | 2 | 101 |
| | 2 | 101 |
| | 2 | 100 |
| 1 | 0 | 101 |
| | 0 | 103 |
| | 0 | 102 |
| | 0 | 101 |
| | 0 | 100 |
| | 1 | 102 |
| | 1 | 102 |
| | 1 | 103 |
| | 1 | 100 |
| | 1 | 101 |
| | 1 | 102 |
| | 2 | 101 |
| | 2 | 101 |
| | 2 | 102 |
| | 2 | 103 |
| | 2 | 100 |
| | 2 | 101 |
| | 2 | 102 |

And the game could be configured so that set 0 would be twice as likely to appear as set 1. Or the game could be configured with a uniform probability of selecting any one set. In this case, several sets might contain the same arrangements of symbols such that the probability of the player receiving a given arrangement of symbols would depend on how may sets contained that arrangement.

Some embodiments use what amounts to special cases of this method, wherein the symbols in certain designated regions on a fixed set of reel strips are randomly changed. By appropriately enumerating every possible changed set of reel strips, one sees that this is indeed a special case of the method described above. Such a symbol substitution method will now be described.

A substitution region will consist of all slots on a fixed set of reel strips

ReelStrips[NUMREELS][MAXNUMSTOPS]

which contain the same fixed symbol number. A substitution pattern, or schema, prescribes for each substitution region a symbol which is to be substituted into every slot of that region. For example, one such schema might substitute the symbol number 100 (representing bar) for every occurrence of the symbol number 101 (representing a cherry).

Such a substitution schema may be presented as an array

SampleSchema[NUMREELS][NUMSYMBOLS]

where NUMSYMBOLS is a number of symbols in a particular game.

Then

SampleSchema[i][j]=k means that every occurrence of symbol j on reel i is to be replaced by symbol k.

A probability distribution of schemas may be represented as an array

Schemas[NUMSCHEMAS][NUMREELS][NUMSYMBOLS]

where NUMSCHEMAS is the number of schemas. The schemas array is a list of schemas, with possible repetitions. A Schemas array would look much like the Reelstrips array described previously. Prior to each spin, a schema is randomly selected with uniform probability form the array, and the reel strips are modified according to the selected schema, and the modified reel strips are spun as usual. Some embodiments use a subset of symbols numbers as regions.

In some embodiments a substitution device is a perturbation table. This is an array Perturb[NUMREELS][NUMSYMBOLS][NUMSYMBOLS]

of weights. Using such a perturbation table, the actual substitution of symbols occurs in two steps. First a schema is randomly selected, as described above. Assume the k-th schema has been selected. Next, for every i<NUMREELS and j<NUMSYMBOLS a symbol number 1 is randomly drawn using the weights perturb[i][Schemas[k][i][j][1];

for 1<NUMSYMBOLS. This symbol number 1, rather than the number Schemas[k][i][j] initially prescribed by schema k, is substituted for every occurrence of symbol number j on reel i. These random draws are independent of one another. In some embodiments the same distribution can be achieved without this service by suitably enlarging the list of schemas. In other embodiments a relatively small list of interesting schemas is identified and variety is added through these random perturbations.

This algorithm can be implemented in the C++ programming language as follows. Assume that ReelStripsForCurrentSpin[NUMREELS][MAXNUMSTOPS]

is an array which is used for the spin and display portion of the game program, and CurrentSchema[NUMREELS][NUMSYMBOLS]

Is an array which holds the schema selected for the current spin. The following C++ code implements the schema selection process using the array of weights perturb. First, a schema number is randomly selected:

```
int schema_num;
schema_num=GetRand(NUMSCHEMAS);
```

Then for each reel number i and each symbol number j the substitution symbol Schemas[schema_num][i][j] is randomly changed according to the perturbation Probabilities derived from the array Perturb, and the value is recorded as Current Schema[i][j].

-continued

```
int SumWeights[NUMREELS][NUMSYMBOLS];
int running_sum, symbol, w, i, j, k;
for(i=0; i<NUMREELS;i++ {
  for(j=0; j<NUMSYMBOLS;j++){
    SumWeights[i][j] = 0
    for(k=0; k<NUMSYMBOLS;k++){
      Sum Weights [i][j]+=Perturb[i][j][k];
    }
  }
}
for(i=0; i<NUMREELS;i++ {
  for(j=0; j<NUMSYMBOLS;j++){
    running_sum = 0;
    symbol = 0
    w = GetRand(SumWeights[i][Schemas[schema_num][i][j]];
      while (running_sum < w){
        running_sum+=perturb[i][Schemas[schema_num][i][j]][symbol]
        symbol++;
    }
    CurrentSchema[i][j] = symbol − 1;
  }
}
```

Then the required substitutions are performed, and the modified reel strips are recorded in the array

```
  ReelStripsForCurrentSpin[NUMEREELS][MAXNUMSTOPS].
for(i=0;i<NUMREELS;i++){
    for(j=0; j<NumStops[i];j++){
      ReelStripsForCurrentSpin[i][j]] = CurrentSchemas[i][ReelStrips[i]
[j]];
    }
}
```

For a slot machine game, the schemas and perturb arrays may be supplied as a text file, in addition to the reel strips, pay table, and other parameters of the game.

One embodiment, nicknamed "Super Stacks", involves using the substitution method described above to create stacks of consecutive positions occupied by the same symbol. The simplest version of a Super Stack game involves a reserved symbol, say symbol number 0, which can be thought of as a black symbol, and a set of reel strips ReelStrips[NUMREELS][MAXNUMSTOPS]

containing, on each reel, sequences of consecutive positions occupied by this blank symbol. Slots containing this symbol are considered as the only substitution region on each reel. If it is assumed, for example, that NOREELS=5, the schemas array reduces to sequence of 5-vectors of symbol numbers. For example, one such schema:

(6,6,6,8,8)

might call for substituting an "Ace" in all blacks on the first 3 reels and a "Jack" in all blanks on the last two. Prior to each spin, a schema is randomly selected from the list, the required substitutions are performed, and the resulting reel stripes are spun.

In other embodiments perturbations may be used, and there may be more than one substitution region per reel.

in another embodiment, the substitution method is used to improve an existing game. In the notion set forth above, an identity schema prescribes that every occurrence of symbol j on reel i be replaced by the same symbol j. if such a schema is selected, the original reel strips are left unchanged if there are no perturbations. Such as schema could be used a relatively large percentage of the time, and different schemas the remainder of the time, thus achieving a modest enhancement of the original game. Alternatively, schemas that involve may substitution for only a few symbols could be used often, thereby achieving a more radical departure from the original game.

Another embodiment, nick-named "Interleaved Reels", starts with two or more sets of reels as in the summary above. These are represented by an array:

ReelStrips[NUMSETS][NUMREELS][MAXNUM-STOPS]

where NUMSETS≤2. An array of schemas of the form

Schema[NUMSCHEMA]NUMREELS];

is also used. Each element of the array Schema is the index of a reel set. Prior to each spin, a number k<NUMSCHEMAS is randomly selected, and a set of reels is assembled as follows. For i<NUMREELS, reel i from reel set schema[k][i] is used. In other words, slot j on reel i is occupied by symbol ReelStrips[Schema[k][i][i]][i][j]. For example, suppose NUMSET=2, and the reel strips of set of number 0 each contain stacks of wild symbols, while the reel strips of set 1 do not. Then for each k<NUMSETS, schema number k is naturally viewed as a five-vector of binary digits. The schema (0,0,0,1,1)

would call for the use of the reel strips from the set containing the stack of wild symbols on the first three reels, and for the use of the reel strips without stacks for the last two reels.

Aspects of various embodiments will now be explained with references to the drawings. FIG. 1 shows various features of a slot machine in which embodiments of the invention may be practiced. A processor 101 controls operations. A coin box 103 may be provided for receiving wagers form a player, although in some slot machines there is no coin box, and wagers may instead be received in the form of paper currency or in other ways. The coin box is in electrical communication with the processor.

One or more manual controls 105 may be provided to enable the player to select various feature of a game. Some slot machines do not provide the player with any choices. In some slot machines a manual control may take the form of a push-button or a lever that starts the play.

A video display such as a cathode-ray tube or flat-panel display 115 provides a visual image of the spinning reels. The display is controlled by the processor. Symbols carried by the reels are displayed in on or more pay line windows such as upper pay line window 117, a middle pay line window 119 and a lower pay line window 121.

The processor is programmed to play one or more games embodying the various principles of play as described above. The programming my take the form of hard-wired instructions as indicated symbolically at 123, or the instructions may be stored in a memory 125. The memory 125 may be a discrete device as shown or it may be part of the processor.

A random number generator 127 may be used to generate schemas, to select symbols for replacement, or for other purposes in connection with the various principles of play as described above. The random generator may take the form of a discrete element in communication with the processor, or it may be embedded in the instruction 123 or memory 125, or it may an integral part of the processor.

In some embodiments the various schemas and symbol substitutions may be computed in advance of play or on-the-fly at the start of each play in the slot machine. Or the computations may be carried out ahead of time in a separate computer system (not shown) and included in the instructions 123 or loaded into memory 125 or communicated to the processor in some other way such as over a communications link 129.

Figure 2:
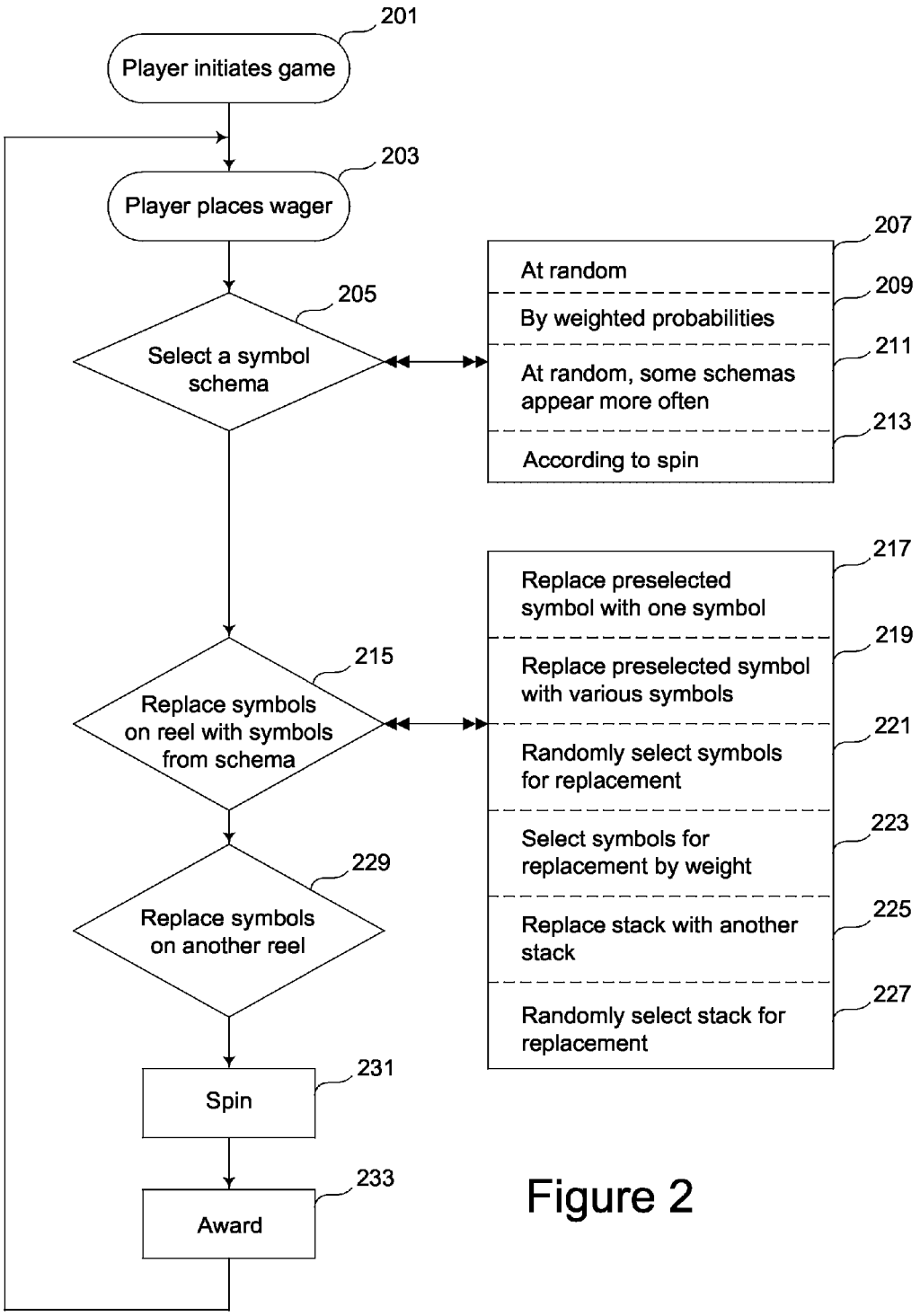
FIG. 2 is a flow chart showing features of embodiments.

FIG. 2 shows the operation of various features of some of the embodiments as described above. A player causes a game to commence (201) and places a wager (203). In some slot machines these two action are only one: the player initiates the play by placing a wager, for example by depositing a coin. A symbol schema is selected (205) by the processor. This may be done by random selection (207), by weighted probabilities where some schemas are weighted toward a more likely selection than others (209), or at random but where some schemas are listed more than once and therefore are more likely of selection (211). In addition to the foregoing, a schema may be selecting according to a count of recent plays (213); for example, a schema may be selected for 70% of the spins and the original symbols may be used for the other 30%.

Where a schema has been selected, symbols on a reel are replaced according to the schema (215). For example, a preselected symbol may be removed whenever it appears on the reel and replaced with one symbol prescribed by the schema (217) or with various symbols prescribed by the schema (219). Symbols may be randomly selected for replacement (221). Symbols may be selected by a weighted procedure (223). A stack of symbols may be replaced with a stack of different symbols once pre reel or every time the stack appears on the reel (225), or a stack may be randomly selected for replacement (227).

Symbols on one or more other reels may also be replaced (229). When all replacing of symbols has been completed, the reels are spun mechanically or in video depiction (213). If a winning combination of symbols appears in a pay line, an award is given (233), for example in the form of a cash payout or in the form of credits that can be used for future games or exchanged for cash at the player's option. The play may repeat at the player's option.

Various embodiments and features have been described, but the invention is not to be limited by any of these embodiments or variations or by anything in the drawings or the forgoing description. The invention is to be limited only by the claims.

We claim:

1. A method of operating a slot machine comprising:

providing a slot machine, the slot machine comprising:

a plurality of reels, each of the reels including a plurality of symbol positions;

a plurality of symbols, at least one of the plurality of symbols located at each of the plurality of symbol positions on each of the reels, wherein the plurality of symbols comprises a reserved symbol being designated for substitution;

a set of symbol replacement schemas, each symbol replacement schema identifying one replacement symbol for replacing the reserved symbol, for each of the plurality of reels, and at least one processor for executing instructions stored on a memory to play a slot machine game comprising the steps:

receiving a command from a player through an input device and relayed to the processor to initiate game play;

selecting, by the at least one processor, a symbol replacement schema;

replacing the reserved symbol on each of the reels with replacement symbols in accordance with the selected symbol replacement schema displaying a portion of the reels after the replacement on a visual display device;

giving an award to the player if a winning combination of symbols appears on the visual display device; and wherein the step of replacing the plurality of symbols occurs after, or substantially simultaneously with, the step of receiving the command from the player and before the step of displaying the reels on the visual display device.

2. A method as in claim 1 wherein the reserved symbol is a blank symbol.

3. A method as in claim 1 wherein the selecting step comprises randomly selecting the symbol replacement schema from among a plurality of schemas.

4. A method as in claim 1 wherein the selecting step comprises selecting the symbol replacement schema according to a weighted probability.

5. A method as in claim 1 wherein the selecting step comprises selecting the symbol replacement schema according to a count of recent plays.

6. A method as in claim 1 wherein some symbol replacement schemas are more likely to be selected than other symbol replacement schemas.

7. A slot machine comprising:

a plurality of reels, each of the reels including a plurality of symbol positions;

a plurality of symbols, at least one of the plurality of symbols located at each of the plurality of symbol positions on each of the reels, wherein the plurality of symbols comprises a reserved symbol being designated for substitution;

a set of symbol replacement schemas, each symbol replacement schema identifying one replacement symbol for replacing the reserved symbol, for each of the plurality of reels; and at least one processor for executing instructions on a memory, to provide a game comprising:

a command from a player through an input device to initiate game play;

a selection, by the at least one processor, of a symbol replacement schema, a replacement of the reserved symbol on each of the reels with replacement symbols in accordance with the selected symbol replacement schema;

a display of a portion of the reels after the replacement on a visual display device;

a display of an award to the player on the visual display device if a winning combination of symbols appears on the visual display; and wherein the replacement of the plurality of symbols occurs after, or substantially simultaneously with, the step of receiving the command from the player an before the display of the reels on the visual display device.

8. A slot machine as in claim 7 further comprising a table to store the symbol replacement schemas.

9. A slot machine as in claim 8 whereby the table is weighted such that some symbol replacement schemas are more likely to be selected than other symbol replacement schemas.

10. A slot machine as in claim 7 wherein the input device comprises a coin box that receives a wager from the player.

11. A slot machine as in claim 7 wherein the selection of a symbol schema comprises the processor randomly selecting a schema from among a plurality of schemas.

12. A slot machine as in claim 7 wherein the selection of a symbol schema is based on a count of recent plays.

13. A slot machine as in claim 7 wherein the reserved symbol is a blank symbols.

14. A game comprising:

a command from a player through an input device to initiate game play;

a selection, by at least one processor, of a symbol replacement schema, a plurality of reels, each of the reels including a plurality of symbol positions;

a plurality of symbols, at least one of the plurality of symbols located at each of the plurality of symbol positions on each of the reels, wherein the plurality of symbols comprises a reserved symbol being designated for substitution;

a selection, by at least one processor, of a symbol replacement schema from a set of symbol replacement schemas, each symbol replacement schema identifying one replacement symbol for replacing the reserved symbol, for each of the plurality of reels;

a display of a portion of the reels comprising the plurality of replacement symbols on a display device;

an award to the player if a winning combination of symbols appears on the visual display; and wherein the replacement of the plurality of symbols occurs after, or substantially simultaneously with, the command from the player and before the display of the reels on the visual display device.

15. The game of claim 14 further comprising a table to store the symbol replacement schemas.

16. The game of claim 14 wherein the reserved symbol is a blank symbol.

17. The game of claim 14 wherein the selection of the symbol replacement schema comprises a random selection of the symbol replacement schema from among a plurality of schemas.

18. The game of claim 14 wherein the selection of the symbol replacement schema comprises a selection of the symbol replacement schema according to a weighted probability.

19. The game of claim 14 wherein the selection of the symbol replacement schema comprises a selection of the symbol replacement schema according to a count of recent plays.

20. The game of claim 14 wherein the some symbol replacement schemas are more likely to be selected than other symbol replacement schemas.

* * * * *